United States Patent [19]

Havins

[11] Patent Number: 5,017,165

[45] Date of Patent: May 21, 1991

[54] APPARATUS FOR AUTOMATICALLY RAISING AND LOWERING BOAT MOTORS

[75] Inventor: Felton H. Havins, Graham, Tex.

[73] Assignee: Aero Marine Engineering, Inc., Bryson, Tex.

[21] Appl. No.: 434,428

[22] Filed: Nov. 13, 1989

Related U.S. Application Data

[63] Continuation-in-part of Ser. No. 283,587, Dec. 13, 1988, Pat. No. 4,995,839.

[51] Int. Cl.[5] ..... B63H 5/12

[52] U.S. Cl. ..... 440/6; 440/53; 440/71; 114/274

[58] Field of Search ..... 440/6, 53, 55, 56, 63, 440/64, 71; 114/39.1, 61, 274, 285; 416/244 B

[56] References Cited

U.S. PATENT DOCUMENTS

| | | | |
|---|---|---|---|
| 2,274,200 | 2/1942 | Hill | 114/274 |
| 3,236,202 | 2/1966 | Quady et al. | 114/61 |
| 3,426,723 | 2/1969 | Specht | 440/63 |
| 3,939,792 | 2/1976 | Wasenius | 440/900 |
| 4,227,480 | 10/1980 | Carras | 440/63 |
| 4,487,152 | 12/1984 | Larson | 114/274 |
| 4,832,642 | 5/1989 | Thompson | 114/285 |
| 4,838,817 | 6/1989 | Travis | 440/6 |

*Primary Examiner*—Sherman D. Basinger
*Assistant Examiner*—Stephen P. Avila
*Attorney, Agent, or Firm*—Geoffrey A. Mantooth; James C. Fails

[57] ABSTRACT

An apparatus for automatically raising and lowering boat motors includes a mounting configuration that allows the motor to move up out of the water and down into the water. A hydrofoil is connected with the motor. When the boat is propelled by a second motor, the water pushes up on the hydrofoil, forcing the first motor up out of the water. A locking device can be used to maintain the first motor in the up position. The locking device can be disengaged to allow the motor and hydrofoil to fall into the water. Alternatively, the motor and hydrofoil can be maintained in the up position by the force of water against the hydrofoil. When the second motor is shut down the motor and hydrofoil automatically drop into the water.

52 Claims, 12 Drawing Sheets

FIG. 6
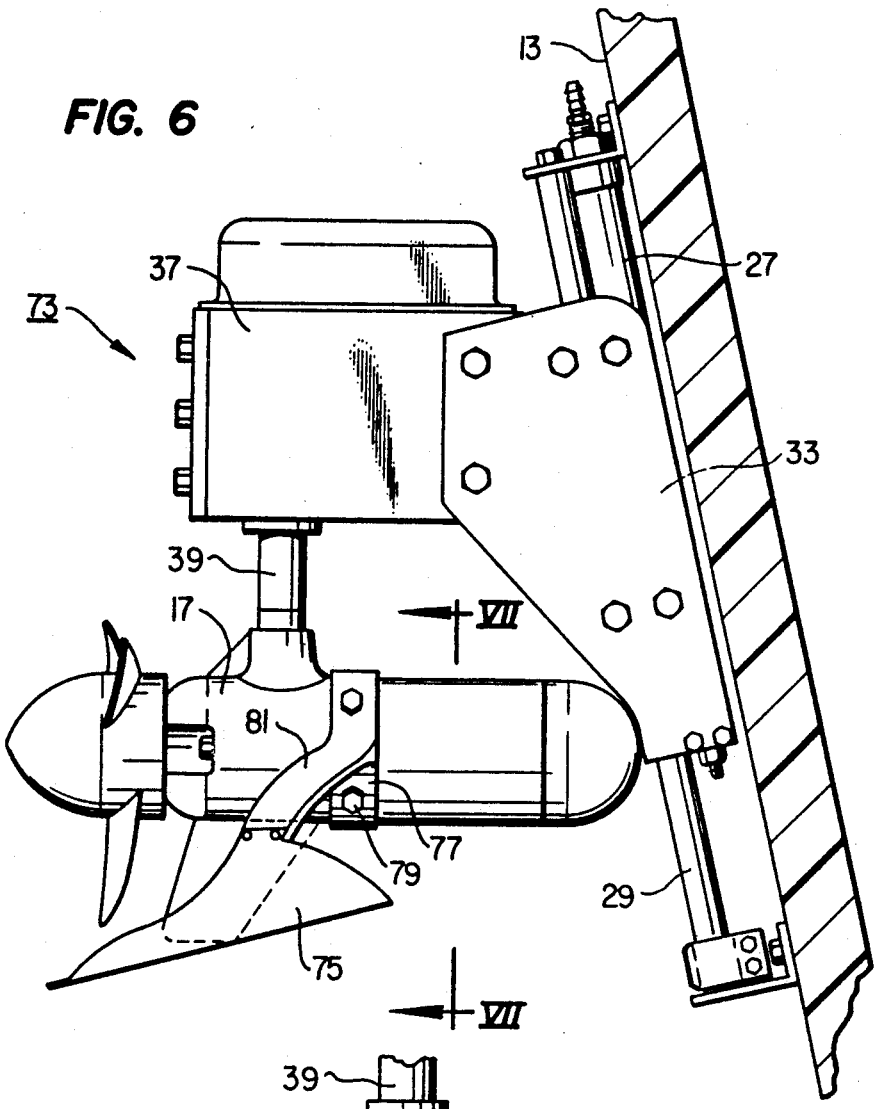
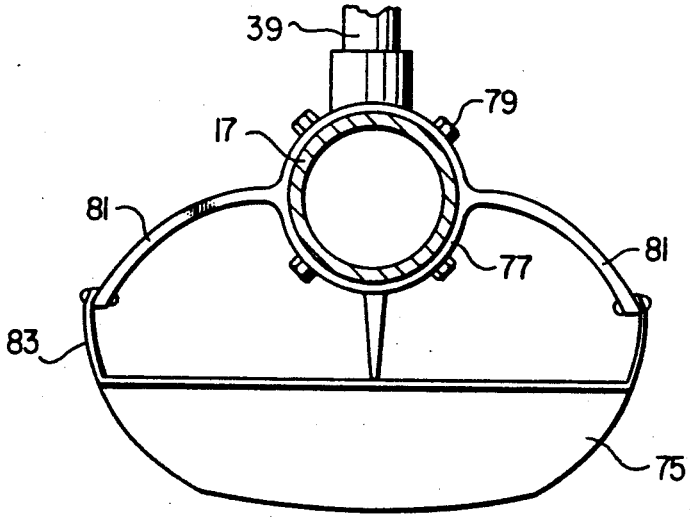
FIG. 7

APPARATUS FOR AUTOMATICALLY RAISING AND LOWERING BOAT MOTORS

This application is a continuation-in-part of my copending application Ser. No. 07/283,587, filed Dec. 13, 1988 now U.S. Pat. No. 4,995,839.

FIELD OF THE INVENTION

The present invention relates to apparatuses for automatically raising boat motors out of the water and to apparatuses for automatically raising and lowering boat motors respectively out of and into the water.

BACKGROUND OF THE INVENTION

Fishing boats are commonly equipped with secondary propulsion means such as electric trolling motors that supplement the primary internal combustion motors. The trolling motor is used to provide quiet propulsion at slow speeds during fishing operations.

When not in use, the trolling motor is stored out of the water, in order to minimize drag on the boat and to prevent damage to the trolling motor when the boat is propelled by the main motor. Prior art trolling motor mounting apparatuses typically require a manual raising and lowering of the trolling motor. Thus to ready the boat for trolling operations, the fisherman must go over to the trolling motor and lower the trolling motor into the water before going to his fishing position. When the fisherman is finished trolling and ready to use the main motor, he must go back over to the trolling motor and lift the trolling motor out of the water to its stowed position. It would be more convenient and easier for the fisherman if the trolling motor could be automatically raised and lowered.

Hamp, U.S. Pat. No. 3,881,443 exemplifies another type of motor mounting apparatus. A small electric motor is provided to automatically raise and lower the trolling motor. The trolling motor and the positioning motor share the same battery. A disadvantage with this type of motor mounting apparatus is that the positioning motor drains the battery and reduces the length of time that the trolling motor can be operated before recharging the battery. The reduction in trolling motor running time becomes noticeable if the positioning motor is frequently used. This same disadvantage is applicable to hydraulically actuated motor mounting apparatuses, which use electrical power from a battery to power the hydraulic pump. Another disadvantage with these types of motor mounting apparatuses is that the trolling motor can be inadvertently left in the down position, which may result in damage to the trolling motor if the boat is operated at high speed by the main motor.

SUMMARY OF THE INVENTION

It is an object of the present invention to provide an apparatus for automatically raising motors. It is another object of the present invention to provide an apparatus that automatically raises and lowers motors.

The apparatus of the present invention includes mounting means for mounting a motor to a boat and hydrofoil means for raising the motor. The mounting means allows the motor to move between a submerged position and an unsubmerged position when the boat is in the water. The hydrofoil means is coupled to the mounting means. As the boat is propelled by a second motor, the water pushes the hydrofoil up, thus automatically lifting the motor up out of the water to the unsubmerged position.

In one aspect, the hydrofoil means is a plate that is mounted beneath the motor. The hydrofoil is positioned at a slight angle to the water line, with its leading edge being higher than the trailing edge. When the boat is propelled by the second motor so as to raise the bow of the boat, the angle increases, thereby increasing the lift of the hydrofoil. In still another aspect, the hydrofoil serves as a protective guard when the motor is submerged.

In another aspect, the apparatus also includes locking means for locking the movable portion of the mounting means and the motor in the unsubmerged position. The locking means has means for unlocking the movable portion and allowing the motor to fall to the submerged position. In still another aspect, the apparatus includes damper means for damping the fall of the movable portion and the motor to the submerged position.

BRIEF DESCRIPTION OF THE DRAWINGS

FIG. 6 is a schematic side view of the apparatus of the present invention, in accordance with another embodiment.

FIG. 7 is a schematic cross-sectional view taken at lines VII—VII of FIG. 6.

DESCRIPTION OF PREFERRED EMBODIMENTS

Figure 1:
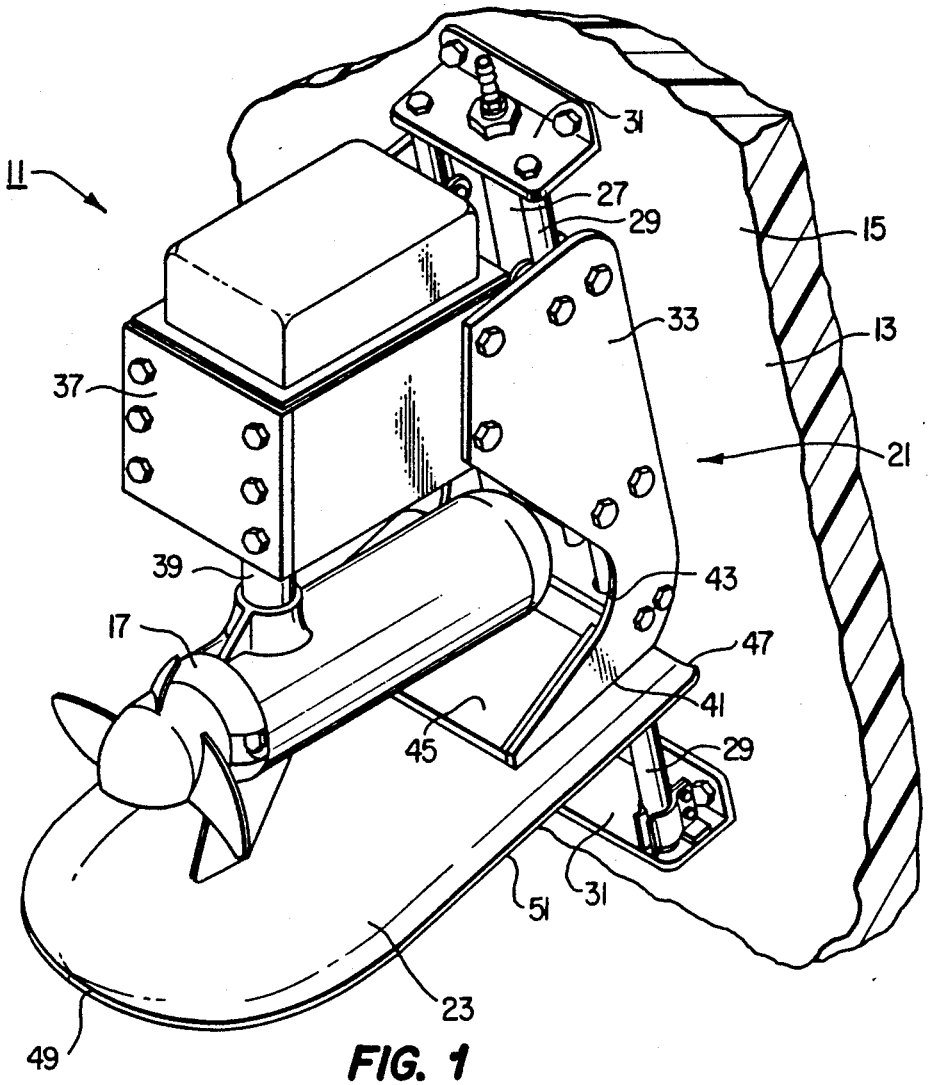
FIG. 1 is an isometric view of the apparatus of the present invention, in accordance with a preferred embodiment, mounted onto a boat transom.
Figure 2:
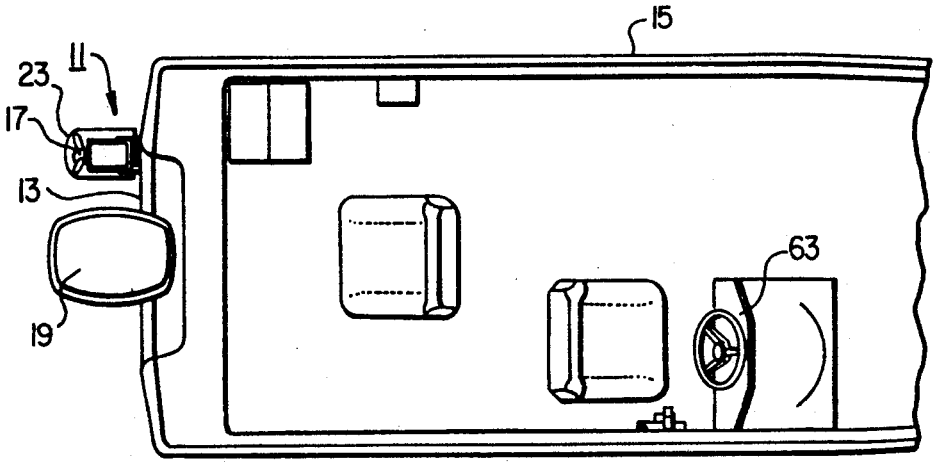
FIG. 2 is a plan view of the stern portion of a fishing boat showing the apparatus of the present invention.

In FIG. 1, there is shown an isometric view of the apparatus 11 of the present invention, in accordance with a preferred embodiment as mounted onto the transom 13 of a boat 15. The boat is equipped with a trolling motor 17 and with a main motor 19 (see FIG. 2). The trolling motor 17 is a conventional electric outboard motor such as may be used for fishing. The main motor 19 is typically gasoline powered and may be of the outboard type or the inboard type. The apparatus 11 is used for automatically raising and lowering the trolling motor 17 out of and into the water when the boat is in the water. In describing the apparatus of the present invention, it will convenient to refer to "up" and "down" with reference to the orientations of the drawings and to the orientation of the boat. The apparatus 11 includes mounting means 21 and a hydrofoil 23. Optional locking means 25 (see FIG. 5) and damping means 27 can be included and are described herein.

Referring to FIGS. 1, and 3–5, the mounting means 21 mounts the trolling motor to the boat while allowing the trolling motor to move up and down between a submerged position, where the trolling motor 17 is submerged in the water and ready for trolling operations, and an unsubmerged position, where the trolling motor is up out of the water for stowage. The mounting means 21 includes a fixed portion and a movable portion. The fixed portion has a pair of cylindrical rods 29 mounted to the boat transom 13 by way of angle brackets 31 at each end of the rods. The rods 29 are parallel to each other and are parallel to the transom 13. The rods 29, which are separated from each other by a short distance, are oriented in a generally vertical direction.

The movable portion has two side brackets 33 that are located on the outer sides of the rods 29. Each side bracket 33 is made up of a plate. The side brackets 33 have respective sets of rollers 35 that protrude inwardly towards the other respective side bracket. The rollers 35 of each side bracket 33 engage the nearest rod 29 in a movable fashion. In order to provide a good coupling between the movable portion and the fixed portion of the mounting means 21, each side bracket 33 has an upper set and a lower set of rollers that engage the respective rod. Each set of rollers has a fore roller, that engages the respective rod on its forward portion, and an aft roller, that engages the respective rod on its aft portion. The side brackets 33 protrude aft, where a steering means 37 is received. The steering means 37 is coupled to the inside portions of the side brackets and is positioned so as to not interfere with the movement of the side brackets 33 relative to the rods 29. A shaft 39 depends from the bottom of the steering means 37. The trolling motor 17 is coupled to the lower end of the shaft 39. The steering means 37 rotates the shaft 39 so as to turn the trolling motor, for steering control of the boat during trolling operations. The steering means is described in more detail in my U. S. patent application Ser. No. 07/075,590, "BOAT SPEED AND DIRECTION CONTROL SYSTEM", filed July 20, 1987. The side brackets 33 have bottom edges 41 that are located below the trolling motor. The trolling motor 17 is positioned so that it can turn without contacting the side brackets 33 or the rods 29. To prevent any such contact, the side brackets 33 are contoured so as to form a notch 43 in the aft edge of each side bracket. With the trolling motor thus mounted to the boat transom, the trolling motor and the side brackets 33 can move between up and down positions. When the boat is in the water, the trolling motor is submerged when it is in the down position. The trolling motor is unsubmerged when it is in the up position. Movement between the up and down positions is accomplished by the rollers 35 rolling along the rods 29. The rollers 35 minimize friction in moving the trolling motor up or down.

The hydrofoil 23 is a plate attached to the bottom edges 41 of the side brackets 33 so as to be located underneath the trolling motor 17. A bracket 45, which is attached to the upper surface of the hydrofoil 23, is coupled to the side brackets 33. The hydrofoil 23 is oriented so as to be generally horizontal when the boat is in the water. The hydrofoil is slightly angled to the water line, when the boat is stationary in the water, with the leading edge 47 higher than the trailing edge 49. This prevents the leading edge 47 from plowing under the water and increasing drag while maintaining the hydrofoil in an orientation where the water will always exert an upward force on the hydrofoil. In the preferred embodiment, the hydrofoil is angled at five degrees to the water line. The trailing edge 49 and the side edges 51 of the hydrofoil are bent slightly upwardly.

The hydrofoil 23 has an area that is sized to produce a sufficient lifting force so as to raise the trolling motor, the steering means, and the side brackets to the up position. The heavier the load that must be lifted, the larger the hydrofoil should be in order to achieve more upward force from the water. The power of the main motor 19 and the size of the boat are also considered in determining the size of the hydrofoil. The faster the boat, when powered by the main motor, the smaller the hydrofoil can be. In the preferred embodiment, the hydrofoil 23 is sized so as to extend the length of the trolling motor and to be much wider than the width of the trolling motor. Thus, the hydrofoil 23 forms a protective guard against underwater obstacles for the trolling motor 17, when the trolling motor is submerged. Because the hydrofoil 23 is attached to the side brackets 33, it remains fixed when the trolling motor 17 is turned for steering.

Figure 5:
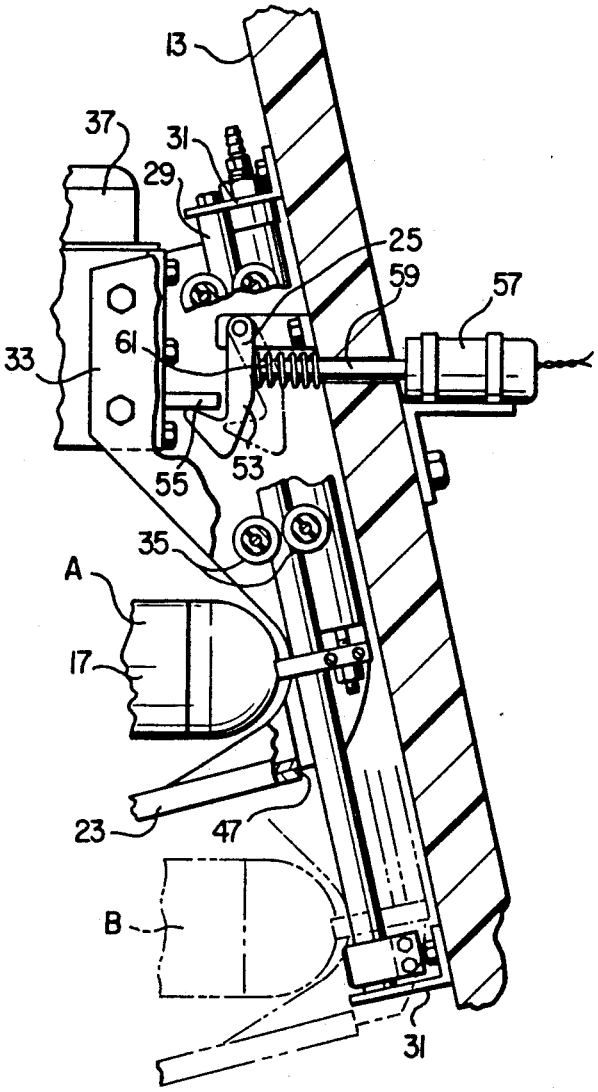
FIG. 5 is a schematic partial cross-sectional view of the boat transom, showing the locking means.

Referring to FIG. 5, the locking means 25 includes a solenoid actuated hook 53. The hook 53 is pivotally mounted to the transom 13 of the boat, between the two rods 29. The hook 53 pivots between fore and aft positions. In the aft position, the hook 53 engages a step 55 on the steering means 37 so as to maintain the trolling motor and the hydrofoil in the up position A. With the hook 53 in the fore position, the hook is disengaged from the step 55, allowing the trolling motor and the hydrofoil to fall to the down position B. The hook 53 is actuated by a solenoid 57 installed inside of the boat. A small hole is bored through the hull to receive the movable solenoid rod 59. The hook 53 is biased in the aft position by a coil spring 61 on the solenoid rod 59. The spring is positioned on the solenoid rod between the hook and the transom. When the solenoid 57 is energized, the hook 53 is pulled to the fore position. When the solenoid is deenergized, the hook returns to the aft position. The solenoid is actuated by a switch (not shown) on the boat operator's control panel 63 (see FIG. 2). The hook 53 is angled upwardly so that as the trolling motor moves to the up position from the down position, the step 55 contacts the lowermost portion of the hook such that the step forces the hook to the aft position. With the hook pushed out of the way, the step can continue to travel upwardly past the hook. When the step has passed the hook, the hook 53 snaps back to the aft position to prevent the step 55 and the trolling motor 17 from falling to the down position.

Figure 4:
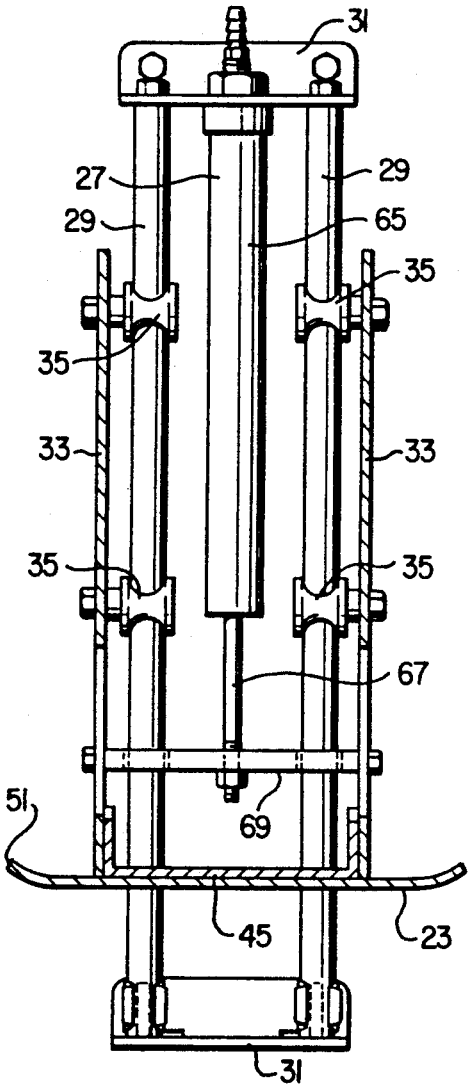
FIG. 4 is a cross-sectional view of the apparatus taken at lines IV—IV of FIG. 3.

The damper means includes a conventional gas spring 27 located between the rods 29 (see FIG. 4). The gas spring 27 has a cylindrical housing 65 and a piston rod 67, which is movable relative to the cylindrical housing. The housing 65 is mounted to the upper angle bracket 31 and the piston rod 67 is mounted to a cross bar 69, which in turn is coupled to the side brackets 33. The gas spring 27 slows the descent of the trolling motor 17 and the hydrofoil 23 into the water to the down position from the up position, in order to prevent a large splash that would scare away fish. The gas spring 27 provides no resistance to the raising of the trolling motor to the up position. In fact, the gas spring can be configured relative to the movable portion such that the gas spring provides some minor assistance in raising the trolling motor and the hydrofoil to the up position.

Figure 3:
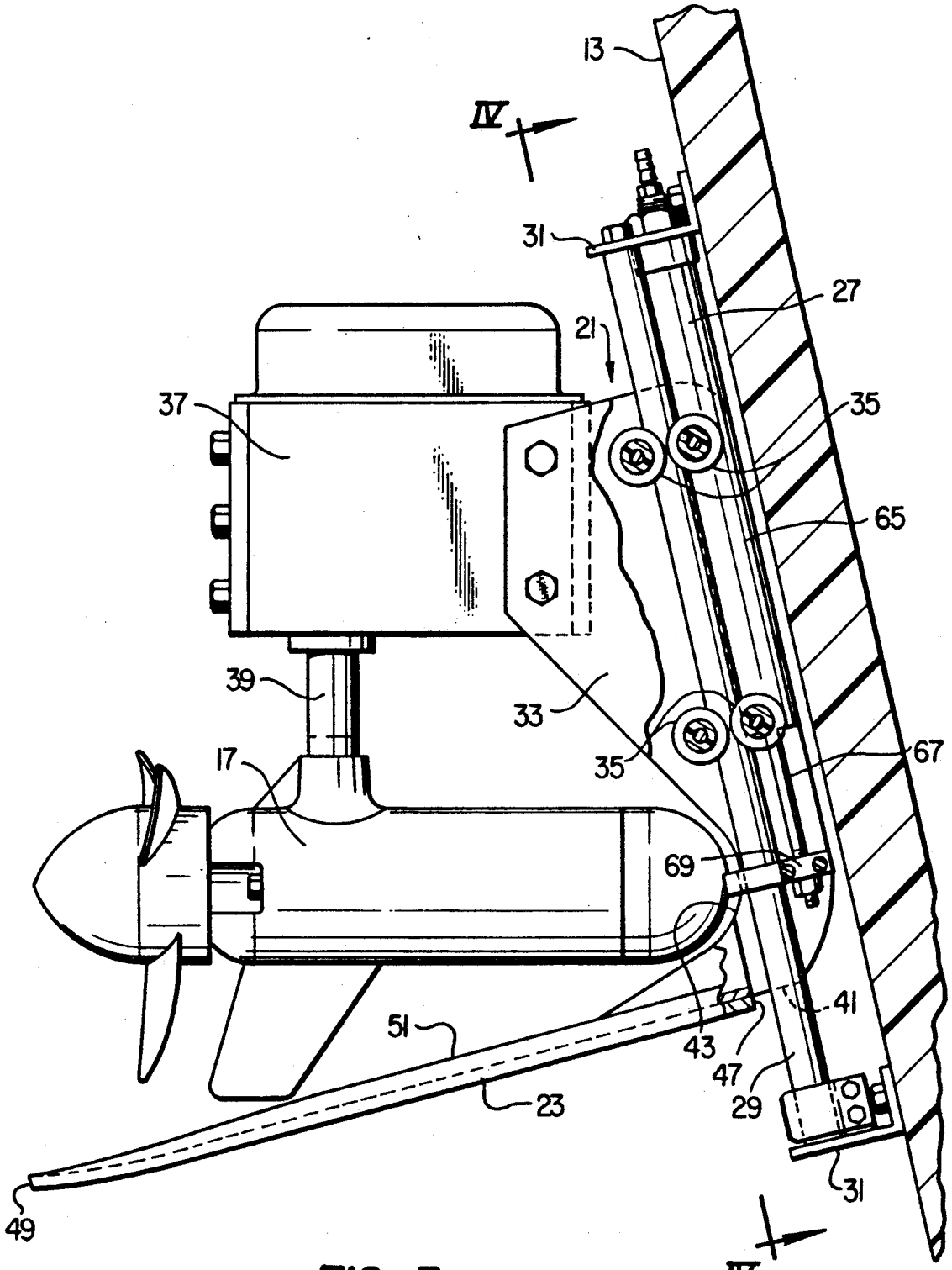
FIG. 3 is a schematic partially cut away side view of the apparatus of FIG. 1.

The operation of the apparatus of the present invention will now be described. With the boat 15 in the water and the trolling motor 17 in the down position, the fisherman need only to start and engage the main motor 19 to propel the boat in a forward direction. The main motor 19 is controlled from the control panel 63 (see FIG. 2). As the main motor propels the boat at a sufficiently high speed, the bow of the boat lifts up in the water, increasing the angle of the hydrofoil to the surface of the water so as to lift the leading edge 47 even higher than the trailing edge 49. This increase in the angle of the hydrofoil to the surface of the water increases the force of water against the hydrofoil. The force of the water against the angled hydrofoil 23 pushes the hydrofoil, the trolling motor !7, the side brackets 33, the rollers 35, and the steering means 37 to the up position. The trolling motor is pushed upwardly more easily when the rods are inclined slightly downward and forward as shown in FIG. 3 because the rods are more aligned with the direction of force on the hydrofoil. Because the hydrofoil is fixed to the side brackets and can't be turned, the trolling motor can be turned in any direction when being lifted; the fisherman need not align the trolling motor into the fore and aft direction before the trolling motor is raised. In the up position, the trolling motor is stowed out of the water, minimizing drag on the boat and preventing damage to the trolling motor by underwater obstacles. The hydrofoil presents minimal drag to the boat when it is in the up position. The trolling motor is maintained in the up position by the hook 53 engaging the step 55. The apparatus 11 is completely automatic in raising the trolling motor out of the water; all the fisherman has to do is drive the boat.

When the fisherman reaches the next fishing spot, he merely actuates the solenoid 57 (if the locking means hook 53 has been utilized to lock the trolling motor in the up position) from the control panel 63 to release the trolling motor 17 and allow the trolling motor 17, the hydrofoil 23, the side brackets 33, the rollers 35, and the steering means 37 to fall into the water. The gas spring 27 slows the fall of the trolling motor and the hydrofoil to prevent a large splash when the trolling motor and hydrofoil enter the water. The trolling motor is now ready for trolling operations. The submerged hydrofoil presents minimal drag to the boat during trolling operations because the hydrofoil is nearly parallel to the surface of the water. The leading edge 47 is angled slightly upward to prevent the hydrofoil from being pushed down deeper.

The locking means can be positioned further up from the waterline, wherein when the trolling motor is in the up position, the locking means hook 53 will not engage the step 55. Instead, the trolling motor is maintained in the up position by the force of water against the hydrofoil. The hydrofoil rides on the surface of the water, ready to automatically drop to the down position when the main motor is shut down. The locking means would be used to secure the trolling motor during trailering operations. The trolling motor can be manually raised to the uppermost position so as to engage the locking means.

In the absence of water, as when, for example, the boat is on a trailer, the boat operator can manually lift the trolling motor to the up position, wherein the locking means would lock the trolling motor. To lower the trolling motor with the boat on a trailer, the operator can either energize the solenoid to release the locking means and allow the trolling motor to fall to the down position or manually disengage the locking means and lower the trolling motor.

In FIGS. 6 and 7, the apparatus 73 of the present invention, in accordance with another embodiment, is shown. In this embodiment, the hydrofoil 75 is attached directly to the trolling motor 17 so as to turn with the trolling motor whenever the trolling motor is turned for steering. The hydrofoil 75 is attached directly to the trolling motor 17 by way of a collar 77. Set screws 79 are used to secure the collar to the trolling motor. The collar 77 has two arcuate arms 81 that extend laterally out to couple to each side of the hydrofoil 75. The sides 83 of the hydrofoil extend arcuately upwardly to meet the arms 81. Most of the hydrofoil 75 is positioned aft of the shaft 39 that couples the trolling motor to the steering means. Thus, when the main motor 19 is engaged, the hydrofoil 75 acts like a weathervane, straightening out the hydrofoil and the trolling motor so as to be aligned in a fore and aft direction. This allows the fisherman to automatically raise the trolling motor without being concerned as to the orientation of the trolling motor or the hydrofoil. The embodiment of FIGS. 6 and 7 operates as described above. For reasons of clarity, the locking means is not shown in FIG. 6.

Figure 8:
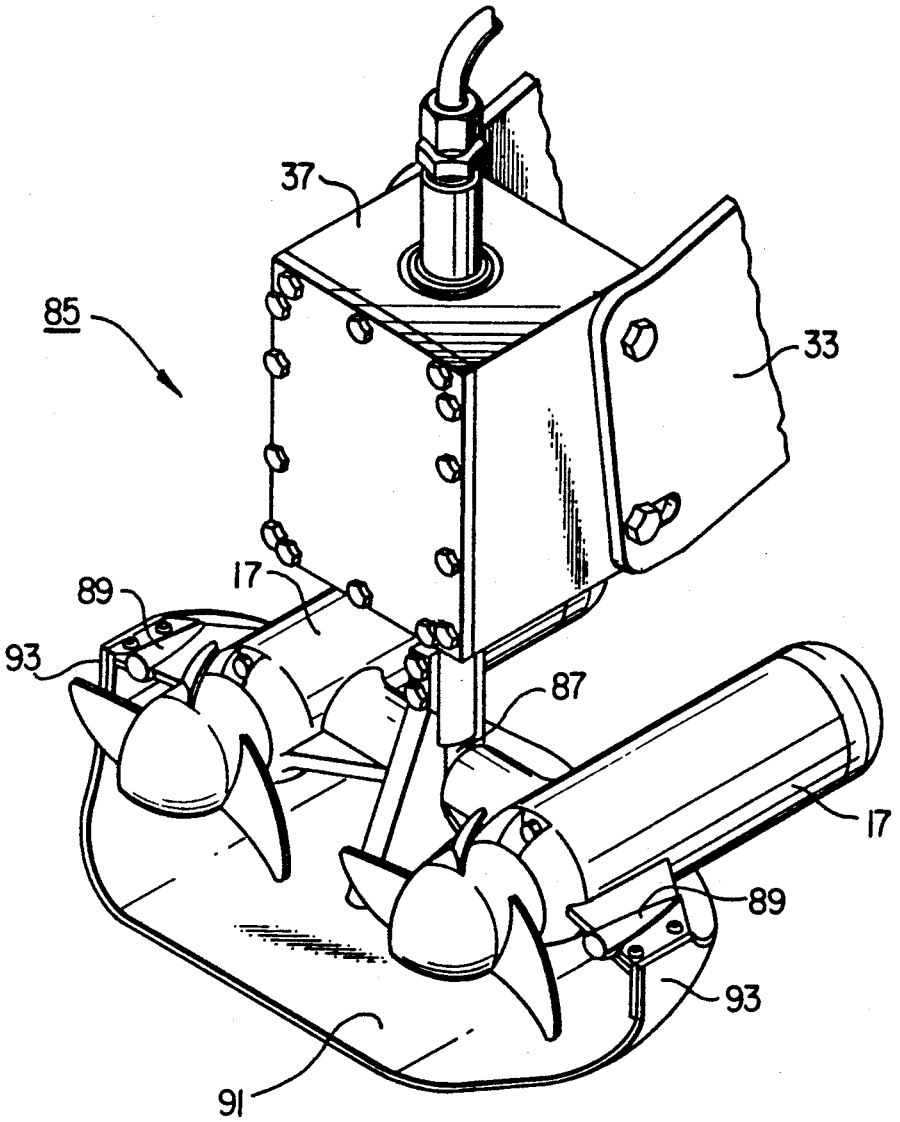
FIG. 8 is an isometric view of the apparatus invention, in accordance with another embodiment.

In FIG. 8, there is shown the apparatus 85 of the present invention in accordance with still another embodiment. In this embodiment, there are two trolling motors 17 mounted to a common shaft 87. The trolling motors are turned sideways to receive the horizontal common shaft 87. The trolling motor stabilizer fins 89 extend laterally outward. The hydrofoil 91 is attached to the trolling motors at the respective stabilizer fins 89. Side portions 93 of the hydrofoil 91 extend upwardly to meet the stabilizer fins 89. Most of the hydrofoil 91 is positioned aft of the common shaft 87 in order to achieve the weathervane effect described above.

Although the apparatus of the present invention has been described with reference to trolling motors, other types of motors could be raised and lowered with the apparatus. For example, internal combustion motors could be lifted with the apparatus. Such motors, which run on gasoline or diesel fuel, may be used on large salt water boats for deep sea trolling. Also, the apparatus has been described with reference to the transom of a boat. However, the apparatus can be mounted to other portions of the hull of a boat.

Although the apparatus has been described as moving between up and down positions by the action of rollers on cylindrical rods, other structural arrangements could be utilized which allow the motor to be moved between a first or submerged position and a second or unsubmerged position. For example, an arrangement which utilizes sliding principles includes a tongue and groove arrangement, where the movable portion has a pair of tongues that slidingly engage grooves in the fixed portion. Another arrangement includes linear bearing means on the movable portion and rods on the fixed portion. The bearing means allow the movable portion to slide up and down along the fixed portion rods.

Figure 9:
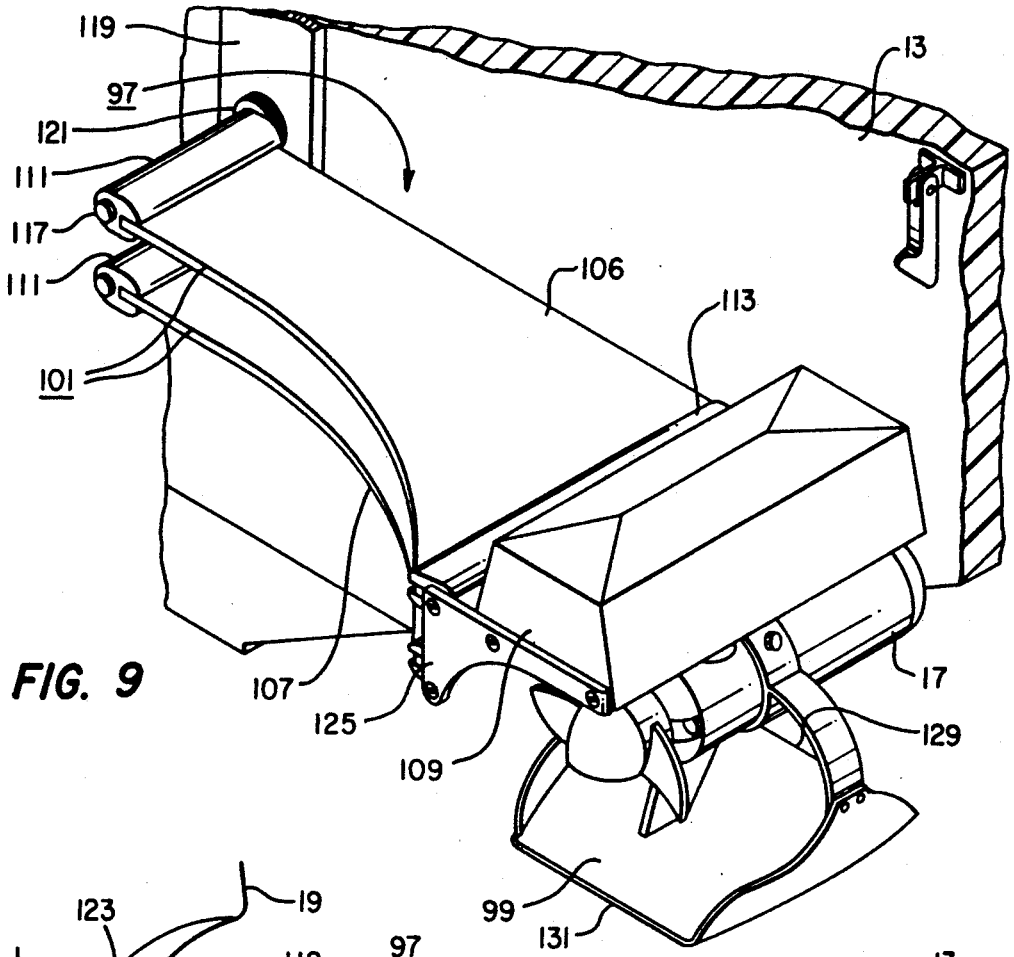
FIG. 9 is an isometric view of the apparatus of the present invention, in accordance with another embodiment, mounted onto a boat transom.
Figure 10:
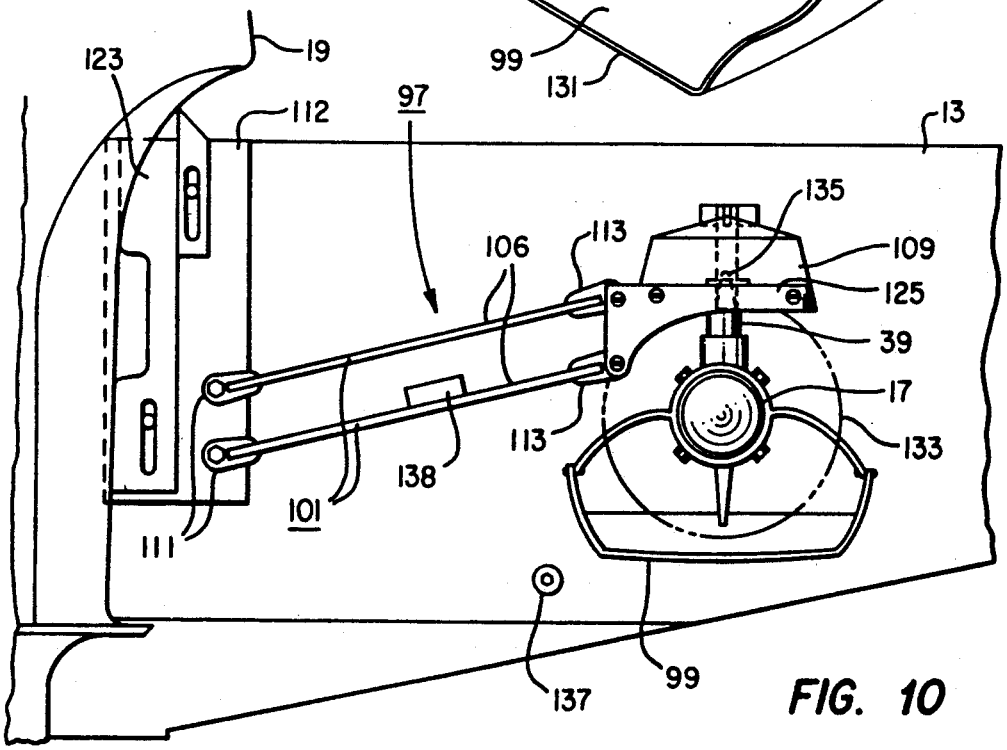
FIG. 10 is a rear end view of the apparatus of FIG. 9.
Figure 11:
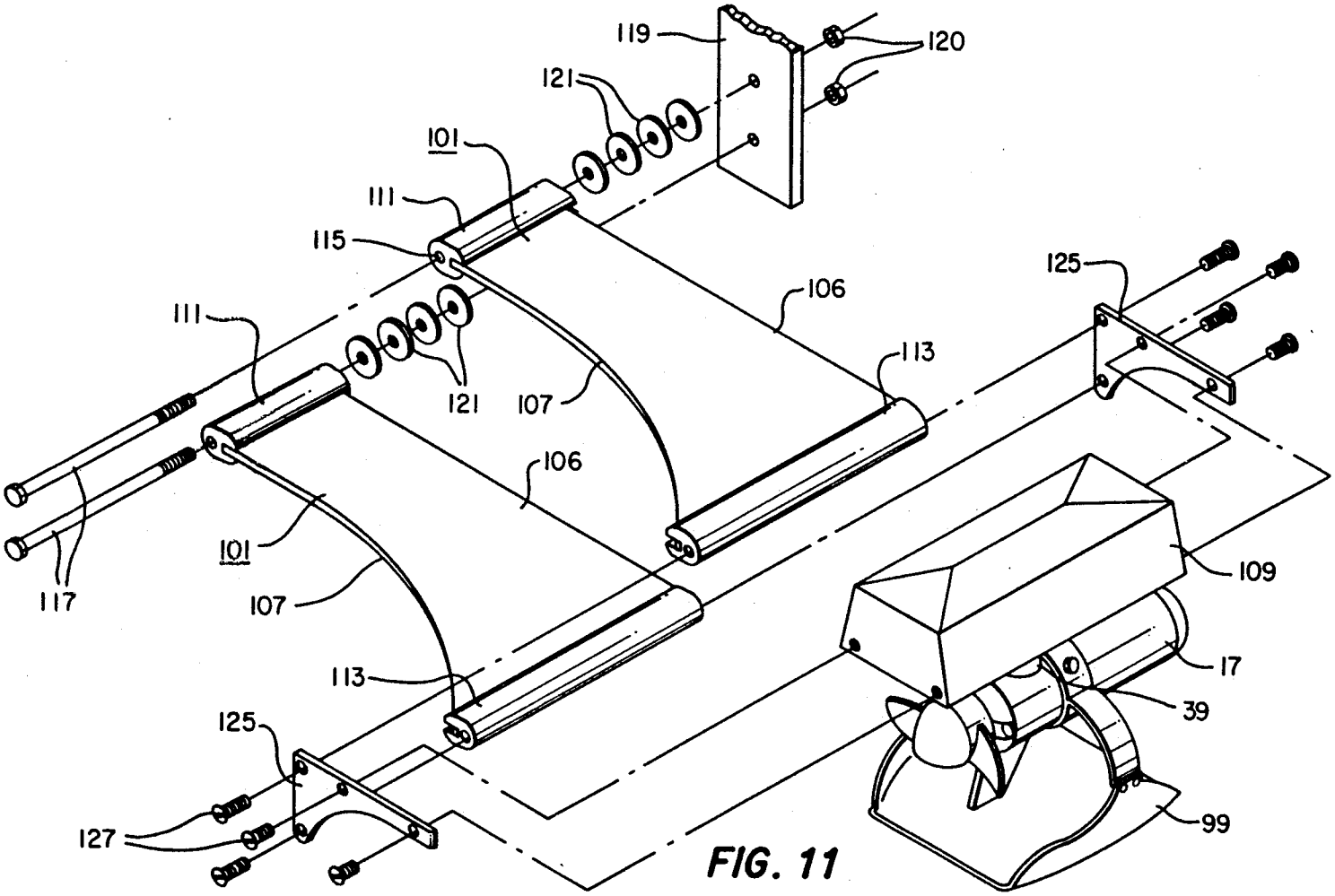
FIG. 11 is an exploded isometric view of the apparatus of FIG. 9.

In FIGS. 9–11 there is shown the apparatus 97 of the present invention, in accordance with another embodiment. In this embodiment, the mounting means for mounting the trolling motor 17 and the hydrofoil 99 to the boat hull includes two pivotable arms 101. Each arm 101 has first and second end blocks 113 and has a generally rectangular flat plate 106. The trailing edge 107 of each arm 101 is tapered rearwardly from the first end block 111 to the second end block 113 to accommodate the length of the steering means 109. Each of the end blocks 111, 113 is elongated and has a groove for receiving the respective end of the respective plate. Each of the first end blocks 111 has a longitudinal cylindrical passage 115 for receiving a bolt 117. The first end block 111 of each arm 101 is pivotally coupled to the boat transom 13 by way of a bolt 117. The bolts 117 are secured to a mounting plate 119 with nuts 120. Plural washers 121 are located on each bolt 117 so as to be interposed between the respective arm 101 and the mounting plate 119. The mounting plate 119 is clamped to the boat transom 13 by the mounting bracket 123 of the main outboard motor 19. The mounting bracket 123 mounts the main motor 19 to the transom !3 of the boat. The mounting plate 119 has a notch (not shown) in its upper edge, which allows the main outboard motor 19 to pivot in and out of the boat. The mounting plate 119 can accommodate two apparatuses 97, one on each side of the main motor 19. Thus, there can be a starboard apparatus, as shown in FIGS. 9 and 10, and a port apparatus, which would be the mirror image of the apparatus shown in FIGS. 9 and 10. The second end blocks 113 of the arms 101 are interposed between two retaining brackets 125. The blocks 113 are pivotally coupled to the retaining brackets 125 with threaded fasteners 127. The retaining brackets 125 extend laterally outward from the arms 101 to receive the steering means. The steering means 109 rotates the shaft 39 of the trolling motor 17 to control the direction of the boat during trolling operations.

The hydrofoil 99 is as described above, having an area that is large enough to produce a sufficient force to raise the trolling motor 17, the steering means 109, and the hydrofoil 99 itself. The hydrofoil 99 is inclined slightly such that its leading edge 129 is higher than its trailing edge 131.

The hydrofoil 99 is located beneath the trolling motor 17 a sufficient distance so as not to interfere with the propeller (the locus 133 of the outermost portion of the propeller is shown in FIG. 10). In addition, the length of the shaft 39 is such that the propeller does not contact the retaining brackets 125, the arms 101, or the steering means 109. The hydrofoil 99 is coupled to the trolling motor 17, although it may be coupled instead to the shaft 39 or to the steering means 109. If the hydrofoil 99 is coupled to either the trolling motor 17 or to the shaft 39, it will rotate with the trolling motor, whenever the trolling motor is rotated by the steering means 109. If the hydrofoil 99 is coupled to the steering means 109 or the arms 101, then it will not rotate with the trolling motor.

When the apparatus 97 is assembled and installed onto the boat hull as shown in FIGS. 9 and 10, the arms 101 extend transversely to the longitudinal axis of the boat, (i.e. along the transom 13). The blocks 111, 113 are oriented in a generally horizontal direction and they are all parallel to each other. The arms 101 are maintained in a parallel relationship with respect to each other. The trolling motor 17, which is pivotally coupled to the second end blocks 113 of the arms, is movable between up and down positions. In the down position, the trolling motor 17 is submerged; in the up position, the trolling motor is located above the water. The hydrofoil 99 lifts the trolling motor 17 from the down position to the up position when the main motor 19 is used. When the main motor 19 is engaged to propel the boat, the force of water pushes the hydrofoil 99 to the up position. The trolling motor 17 and the hydrofoil 99 move along an arcuate path, because of the pivoting of the arms 101. The trolling motor 17 is maintained in the up position by a solenoid-actuated hook 135 mounted to the boat hull. The hook 135 engages a ring (not shown) on the steering means 109.

The downward travel of the trolling motor 17, the hydrofoil 99, and the arms 101 are limited by a stop 137. The stop 137 protrudes out from the transom 13 of the boat to a distance where it can contact one of the arms 101. In the preferred embodiment, the stop 137 is a hard rubber lug that is bolted to the transom 13. Alternatively, a block 138 can be attached to one of the arms 101 so as to be interposed between the two arms. By controlling the spacing between the two arms 101 and the distance the block protrudes from its arm, the extent of downward movement of the trolling motor 17 can be limited. Still another alternative to limit downward movement is to use a line. One end of the line is secured to the boat hull, at a point above the up position of the apparatus. The other end is secured to the second end of one of the arms 101. By controlling the length of the line, the extent of downward movement of the trolling motor 17 can be controlled.

As the arms 101 move the motor 17 up or down, the arms remain parallel with respect to each other. This is because the arms are pivotable with respect to mounting plate 119 and the retaining brackets 125. The trolling motor remains in the same orientation relative to the water line of the boat such that the shaft 39 remains vertical. Likewise, the hydrofoil 99 maintains the same orientation relative to the water line of the boat.

Figure 12:
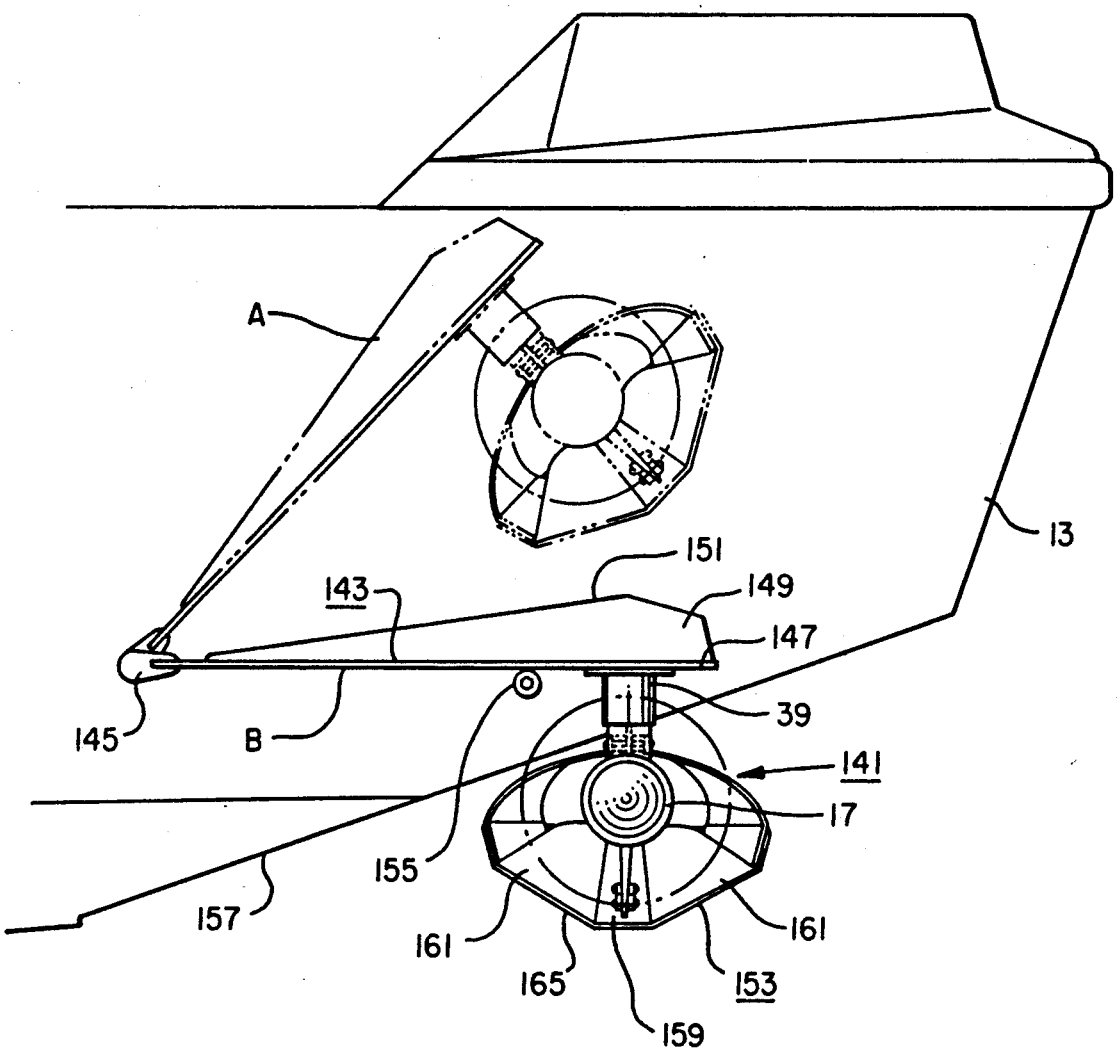
FIG. 12 is a rear end view of the apparatus of the present invention, in accordance with another embodiment, mounted onto a boat transom.

In FIG. 12, there is shown the apparatus 141 of the present invention, in accordance with another embodiment. The mounting means of the apparatus of FIG. 12 is similar to that of FIGS. 9–11, except that a single pivoting arm 143 is used, instead of plural arms. The single arm 143 has first and second ends 145, 147 with the first end being pivotally coupled to the boat hull at the transom 13. The first end can be mounted to a mounting plate, or else mounted directly to the transom 13 via a pin projecting out of the transom. The second end 147 is coupled to the trolling motor 17 via a shaft 39. Steering means 149, mounted on the upper portion of the second end 147 of the arm 143, rotates the trolling motor 17 for directional control. The steering means is housed within a streamlined cover 151 that extends for most of the length of the arm. The hydrofoil 153 is coupled to the shaft 39, although it may be coupled instead to the trolling motor 17 or to the second end 147 of the arm 143. The arm pivots between up and down positions A, B. In the up position A the trolling motor 17 is out of the water. In the down position B the trolling motor is submerged. The trolling motor 17 is maintained in the up position A by a solenoid actuated hook. The downward travel of the trolling motor is limited by a stop 155 that protrudes out from the boat hull.

Because the trolling motor 17 is rigidly coupled to the arm second end 147 (except for rotation for directional control) the trolling motor 17 and the hydrofoil 153 perform a slight roll as they move along the arcuate pivot path. Thus, as shown in FIG. 12, as the trolling motor and the hydrofoil move from the down position B to the up position A, they roll in a counterclockwise direction. In spite of this rolling motion, the hydrofoil 153 is still able to raise the trolling motor to the up position A. This is because the bottom 157 of the boat hull is usually inclined at the transom, so that the water planes diagonally off of the bottom, at the transom.

In the embodiment of FIG. 12, the hydrofoil 153 is bent upwardly at the sides. Thus, the hydrofoil 153 has a flat bottom portion 159 and flat side portions 161 that extend outwardly from the bottom portion. The side portions 161 are inclined upwardly from the bottom portion 159. The leading edge of the hydrofoil is higher than the trailing edge 165 so that the whole hydrofoil is inclined with respect to the water line of the boat. The inclined side portions 161 give the hydrofoil a contoured shape that allows the hydrofoil 153 to provide a lifting force even when the boat is executing a turn. Frequently, when the operator engages the main motor, the boat commences a turn, causing the boat to roll slightly to one side. The bent shape allows the hydrofoil 153 to roll with the boat and still plane in the water to provide lift. The hydrofoil 153 is substantially similar to the hydrofoil 173, shown in FIGS. 13, 14, and 16, and which will be described in more detail hereinafter.

The apparatuses 97, 141 of FIGS. 9–12 are useful when there is very little space on the transom 13 to mount equipment. For example, some boats have the outside corners of the transom cropped off to enhance speed. On such boats, the apparatuses 97, 141 of FIGS. 9–12 are easily installed onto the smaller transom. In addition, the apparatuses are easily installed onto transoms having odd curvatures.

Figure 13:
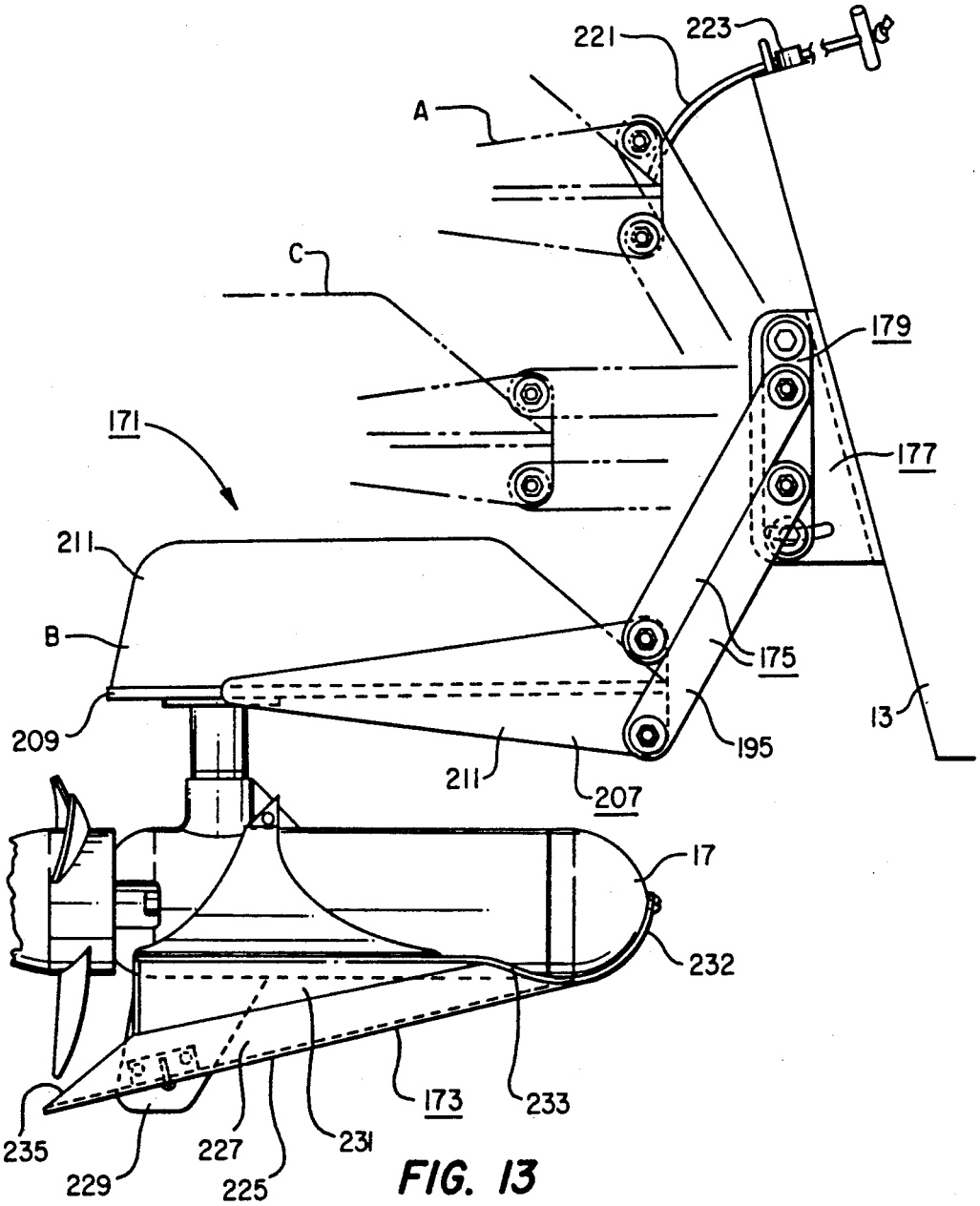
FIG. 13 is a side view of the apparatus of the present invention, in accordance with another embodiment, mounted onto a boat transom.
Figure 14:
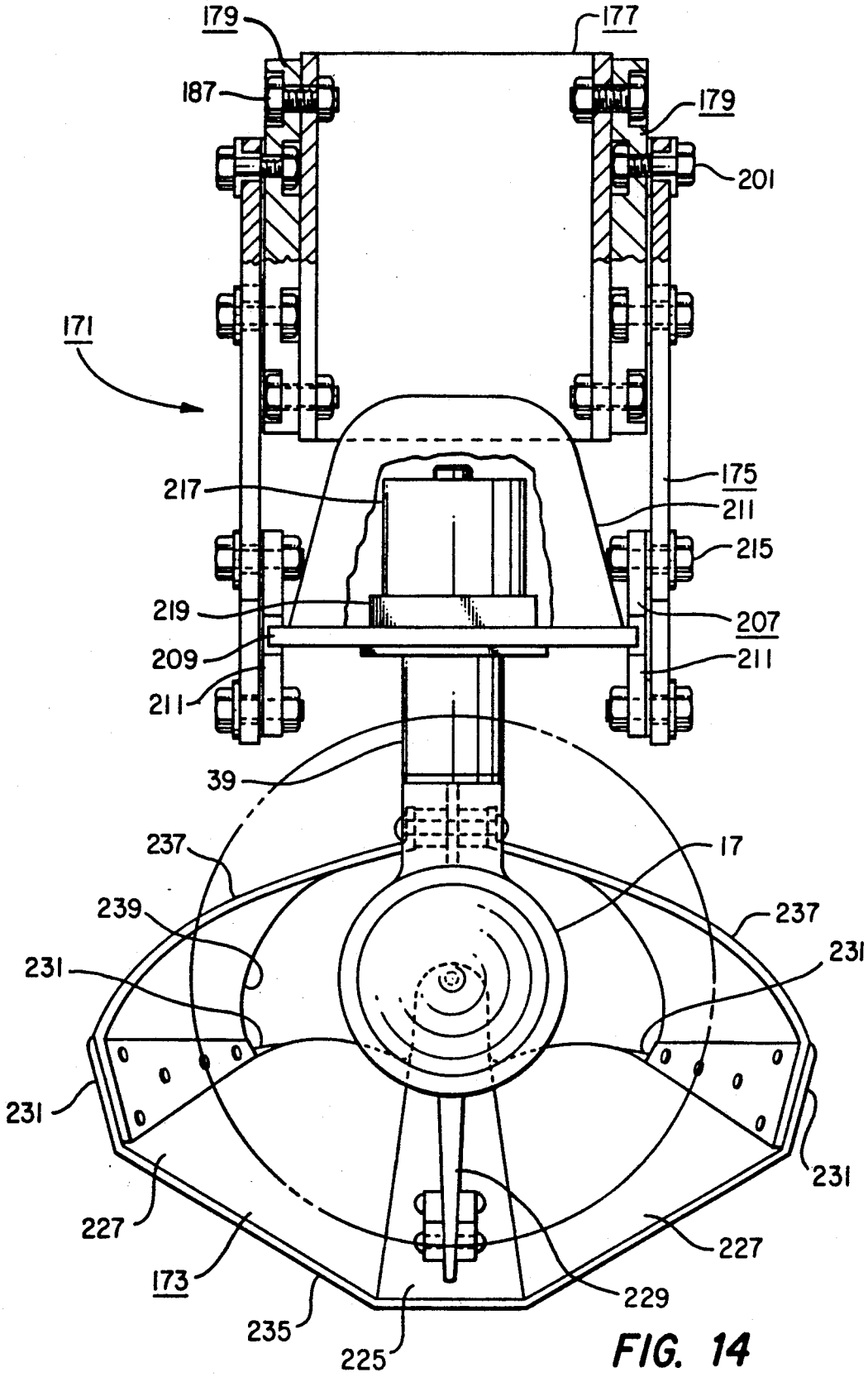
FIG. 14 is an end view of the apparatus of FIG. 13 shown in partial cross-section.
Figure 15:
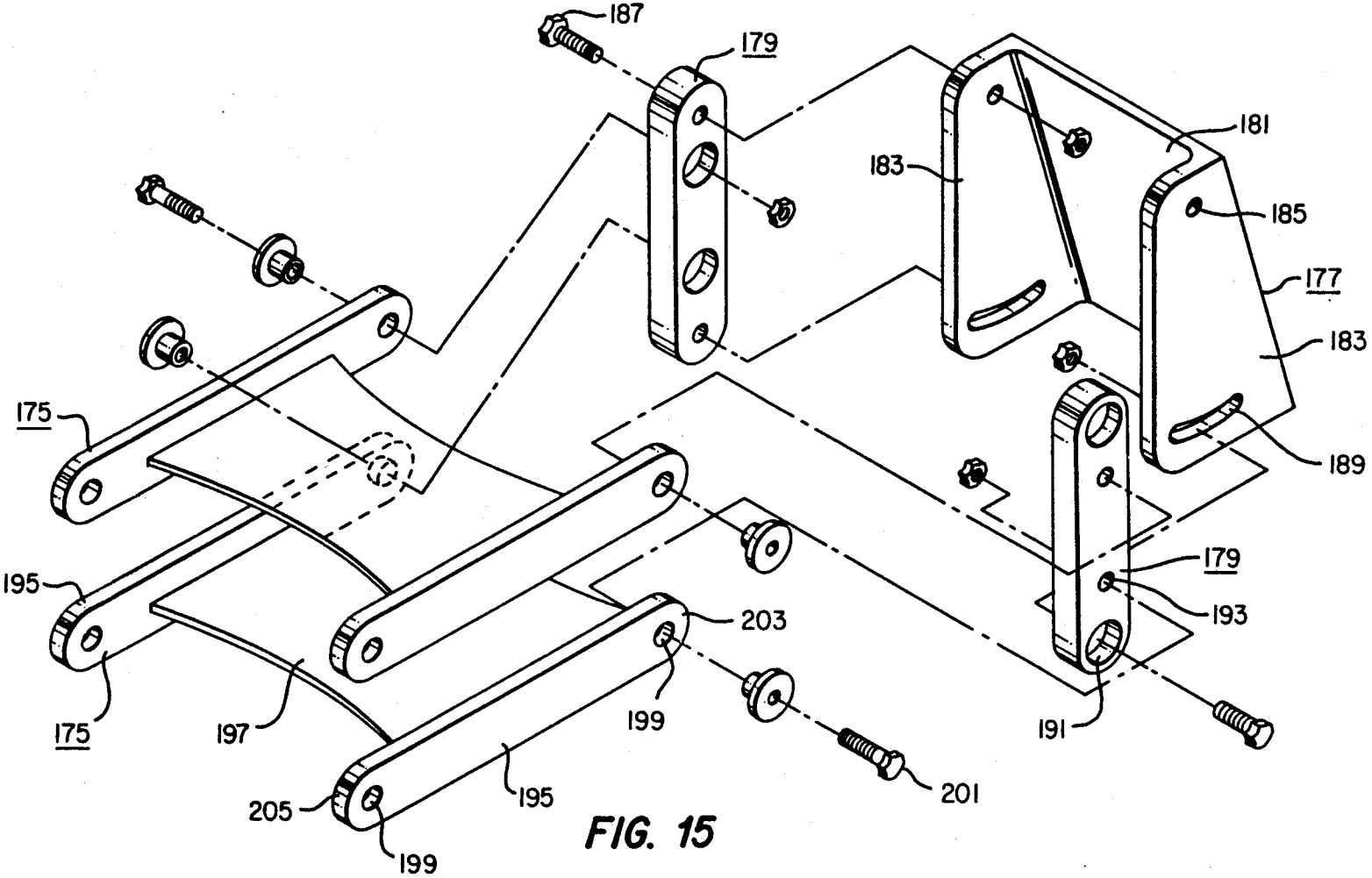
FIG. 15 is an exploded isometric view of the mounting means of the apparatus of FIG. 13.

In FIGS. 13–15, there is shown the apparatus 171 of the present invention, in accordance with still another embodiment. In this embodiment, the trolling motor 17 and the hydrofoil 173 move in and out of the water on arms 175 the pivot about an axis that is perpendicular to the longitudinal axis of the boat.

The mounting means includes a mounting bracket 177, side bars 179, and two arms 175. The mounting bracket 177 has a back plate 181 for attachment to the transom of a boat. Two side plates 183 protrude outwardly from the back plate. The side plates 183 are perpendicular to the back plate 181 and are vertical in orientation. The upper end of each side plate has a circular opening 185 for receiving a bolt 187, while the lower end of each plate has an arcuate slot 189 for allowing adjustment of the orientation of the side bars 179. (In this regard, the mounting bracket is like the bracket 33 shown in FIG. 8.) Each side bar 179 has four openings for receiving bolts. Thus, each side bar has an opening 191 at each of its ends and two intermediate openings 193. The side bars 179 bolt onto the side plates 183 of the mounting bracket 177 via the respective openings 185 and slots 189. The slots 189 allow the side bars 179 to be pivoted about their upper ends, such that the side bars are positioned in a generally vertical orientation.

Each arm 175 has two parallel bars 195 that are connected together by a web 197. The respective ends of each bar 195 have respective openings 199 for receiving bolts 201. One end 203 of each arm 175 is pivotally coupled to the side bars 179 at the respective intermediate openings 193. (In FIG. 15, some of the fasteners are omitted for clarity.) The other end 205 of each arm 175 is pivotally coupled to a motor mounting bracket 207.

The motor mounting bracket 207 includes a horizontal base plate 209 for supporting the steering means 211 and the trolling motor 17. The base plate 209 has two side plates 213 extending along the sides of the base plate. The side plates 213 are perpendicular to the base plate 209. At the forward end of each side plate 213 are openings for pivotally coupling to the arms 175 by way of bolts 215.

The steering means 211 is located on top of the base plate 209. A vertical shaft 39 protrudes downwardly through an opening in the base plate 209. The trolling motor 17 is coupled to the lower end of the shaft 39. Referring to FIG. 14, the steering means 211 includes a steering motor 217 to rotate the shaft about a vertical axis so as to change the direction of thrust produced by the trolling motor 17. Speed reduction means 219, in the form of a gear box, is used to rotatably couple the steering motor 217 to the shaft 39. The steering motor 217 is controlled by the boat operator via a controller (not shown).

Figure 16:
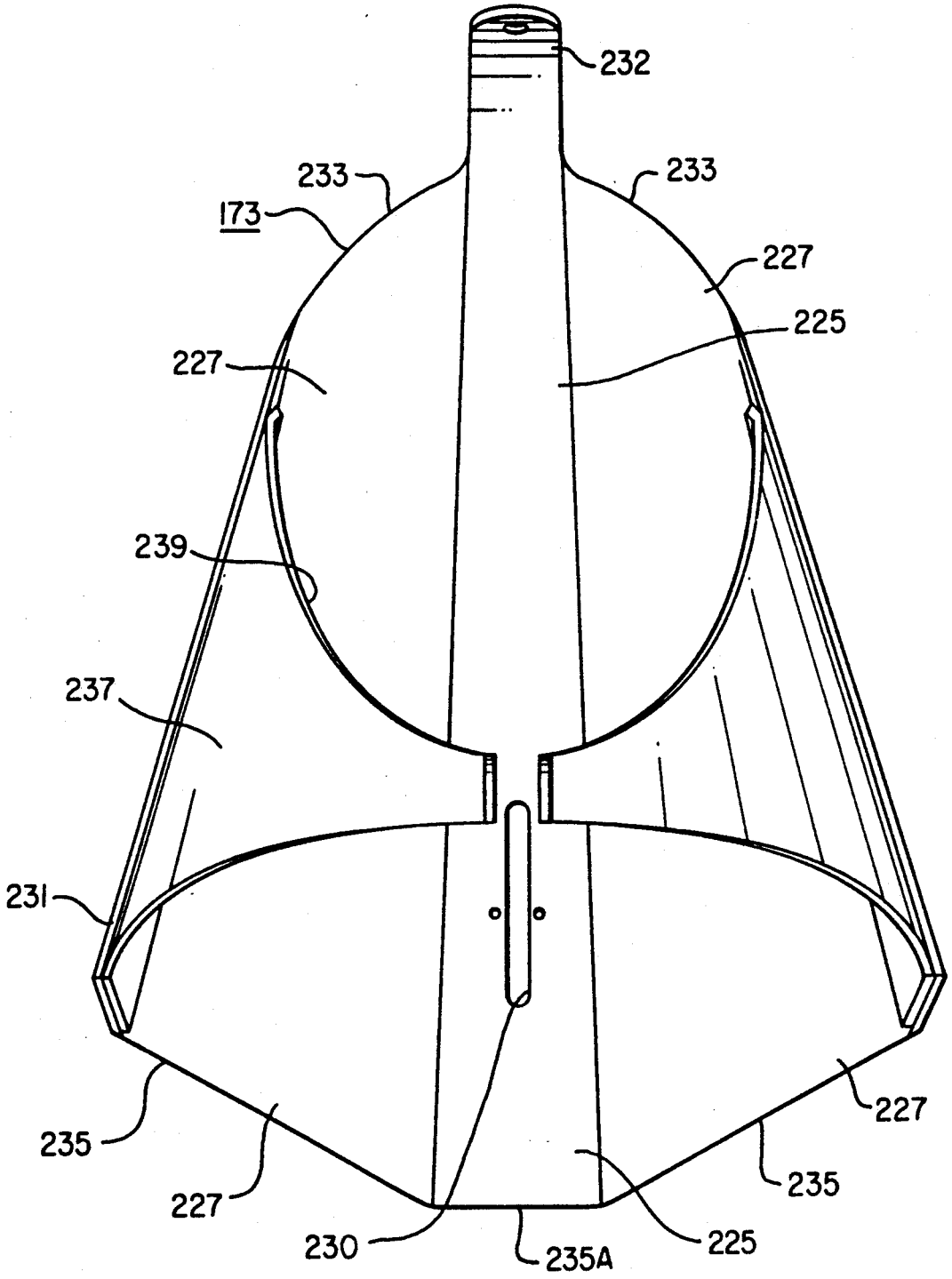
FIG. 16 is a plan view of the hydrofoil shown in FIGS. 13 and 14.

Referring to FIGS. 13, 14, and 16, the hydrofoil 173 has a bottom portion 225 and flat side portions 227 that extend outwardly from the bottom portion. The side portions 227 are inclined upwardly from the bottom portion 225. The stabilizer fin 229 of the trolling motor 17 is coupled to the bottom portion 225, and may even protrude therethrough, depending on the angle of the hydrofoil. In the preferred embodiment, the hydrofoil 173 is provided with an opening 230 in the bottom portion for receiving the stabilizer fin 229. The hydrofoil 173 also has outer side portions 231 that are inclined upwardly from the respective side portions 227. The bottom portion 225 is generally flat, except at its forward end 232 where it curves upwardly for attachment to the nose of the trolling motor 17. The side portions 227 have leading edges 233 and trailing edges 235. Each side portion 227 is tapered such that it is narrower at its leading edge 233 than at its trailing edge 235. The hydrofoil 173 thus has a tapered shape as shown by FIG. 16, with a narrow forward portion (which is by the leading edges 233) and a broader rearward portion (which is by the trailing edges 235). The outer side portions 231 are generally triangular, with the base of the triangle at the rearward end. The trailing edge 235A of the bottom portion 225 merges with the side portion trailing edges 235. The side portion trailing edges 235 are inclined in a forward direction from the bottom portion 235 to the outer side portions 231. Arcuate coupling members 237 couple the outer side portions 231 to the trolling motor 17. The leading edges 239 of the coupling members 237 are arcuate for streamlining purposes. In the preferred embodiment, the bottom, side and outer side portions 225, 227, 231 are integral and are formed by a piece of stamped metal. The hydrofoil 173 provides lift during a turn, when the boat is rolling to one side. In addition, the hydrofoil, with most of its mass located rearwardly, causes the trolling motor to weathervane, wherein when the main motor is engaged, the hydrofoil will automatically straighten the trolling motor so that the trolling motor is oriented in a fore and aft direction. If a gearbox 219 is used in the steering means, the gearbox should be configured to allow the shaft 39 to rotate freely to permit weathervaning. However, the gearbox 219 could be configured to prohibit independent rotation of the shaft 39, thereby precluding weathervaning. It so, the hydrofoil 173 will still raise the trolling motor 17.

The hydrofoil 173 is attached to the trolling motor 17 as shown in FIGS. 13 and 14. Alternatively, the hydrofoil can be attached to the shaft 39 or to the motor mounting bracket 207.

When the apparatus 171 is assembled and installed onto the boat transom 13, the arms 175 extend aft (or rearwardly) of the boat. The arms 175, which are parallel to each other, pivot the trolling motor and hydrofoil between submerged (or down) and unsubmerged (or up) positions B, A (see FIG. 13). The arms 175 pivot at the mounting bracket 177 about axes that are perpendicular to the longitudinal axes of the boat. In the submerged position B, the arms 175 contact each other, wherein any further downward movement is prevented. As the main motor 19 is engaged and the hydrofoil 173 pushes the trolling motor 17 and the steering means 211 up, the arms 175 reach an intermediate position C, where they are generally horizontal in orientation. In the intermediate position C, the arms 175 are separated from each other by a gap. The trolling motor and the hydrofoil are pushed up to the up position, and the arms 175 once again contact to prevent further upward movement. A line 221 having one end secured to the motor mounting bracket 207 is used to retain the trolling motor 17 in the up position. The line 221 is secured by a conventional cam cleat 223 on the boat hull. Because the motor mounting bracket 207 is pivotally coupled to the arms 175, the base plate 209 remains in a horizontal orientation during up and down movements of the trolling motor, and the hydrofoil 173 maintains its orientation to the water line of the boat.

The mounting bracket 177 is adapted for use with a wide range of transom types. Boat transoms frequently vary in their inclination to the water line of the boat. Some transoms are vertical, while others are inclined downwardly and forwardly as shown in FIG. 13. The specific angle of inclination of a particular transom can be adjusted for by pivoting the side bars 179 in the arcuate slots 189 of the mounting brackets 177. The side bars 179 are oriented so as to be generally vertical, such that the trolling motor 17 is horizontal. Alternatively, the inclination of the mounting bracket 177 can be changed by inserting wedges between the mounting bracket and the transom 13.

The apparatus 171 of FIGS. 13–15 offers the advantage of protecting the trolling motor from underwater objects. If the trolling motor or the hydrofoil hits an underwater object, the impact will push the motor up and out of the way, thus reducing the likelihood of damage.

The foregoing disclosure and the showing made in the drawings are merely illustrative of the principles of this invention and are not to be interpreted in a limiting sense.

I claim:

1. An apparatus for automatically raising first propulsion means on a boat, said boat having second propulsion means, comprising:

(a) mounting means for mounting said first propulsion means to said boat, said mounting means comprising track means for guiding the movement of said first propulsion means and travelling means for moving along said track means, said travelling means being constrained as to movement along said track means, said first propulsion means being coupled to one of said track means or said traveling means with the other of said track means or said travelling means coupled to said boat such that said first propulsion means can move between a submerged position and an unsubmerged position when said boat is in the water;

(b) hydrofoil means for raising said first propulsion means from said submerged position to said unsubmerged position when said boat is being propelled by said second propulsion means, said hydrofoil means being coupled to said mounting means, said hydrofoil means being adapted to be submerged when said first propulsion means is in the submerged position.

2. The apparatus of claim 1 wherein said hydrofoil means comprises a plane surface having leading and trailing edges, which plane surface is adapted for obtaining a reaction in the form of a lifting force from the water when said boat is being propelled by said second propulsion means.

3. The apparatus of claim 2 wherein said plane surface comprises lateral edges, said plane surface comprising curved portions near said lateral edges.

4. The apparatus of claim 1 wherein said hydrofoil means comprises a plate that is generally horizontal in orientation.

5. The apparatus of claim 4 wherein said first propulsion means comprises a trolling motor.

6. An apparatus for automatically raising an outboard motor on a boat, said boat having propulsion means in addition to said outboard motor, comprising:

(a) mounting means for mounting said motor to said boat, said mounting means comprising:

(i) a fixed portion which is fixed to said boat;

(ii) a movable portion moveably coupled to said fixed portion, said motor coupled to said movable portion, said movable portion moving between a first position where said motor is submerged when said boat is in the water and a second position where said motor is unsubmerged when said boat is in the water;

(b) hydrofoil means for automatically raising said movable portion from said first position to said second position when said boat is being propelled by said propulsion means, said hydrofoil means comprising a plate that is generally horizontal in orientation, said hydrofoil means being coupled to said movable portion so as to be submerged when said movable portion is in the first position and said boat is in the water.

7. The apparatus of claim 6 further comprising means for locking said movable portion in the second position.

8. The apparatus of claim 6 wherein said hydrofoil means comprises a plane surface having leading and trailing edges, which plane surface is adapted for obtaining a reaction in the form of a lifting force from the water when said boat is being propelled by said propulsion means.

9. The apparatus of claim 8 wherein said plane surface comprises lateral edges, said plane surface comprising curved portions near said lateral edges.

10. An apparatus comprising:

(a) mounting means adapted for mounting an outboard motor onto a boat, said mounting means comprising:

(i) a fixed portion adapted to be fixedly coupled to said boat;

(ii) a movable portion moveably coupled to said fixed portion, said movable portion adapted to be coupled to said motor, said movable portion moving between a first position where said motor is submerged when said boat is in the water and a second position where said motor is unsubmerged when said boat is in the water;

(b) hydrofoil means for automatically raising said movable portion from said first position to said second position when said boat is being propelled through the water by alternative propulsion means, said hydrofoil means being coupled to said movable portion so as to be submerged when said movable portion is in the first position, wherein said hydrofoil means is located beneath said motor when said motor is coupled to said movable portion, said hydrofoil means having a central portion that is oriented so as to be generally horizontal and sides that extend laterally outward from said central portion, said hydrofoil means being contoured such that said sides extend upwardly from the central portion of said hydrofoil means when the apparatus is mounted onto a boat.

11. The apparatus of claim 10 wherein said hydrofoil means has leading and trailing edge portions and has a tapered shape in the fore and aft direction such that said trailing edge portion is wider than said leading edge portion.

12. The apparatus of claim 11 wherein said leading edge portion is higher than said trailing edge portion when the apparatus is mounted onto a boat.

13. The apparatus of claim 12 wherein said hydrofoil means is adapted to couple to said motor, said motor being adapted to turn about a vertical axis, said hydrofoil means having most of its mass located rearwardly so as to automatically straighten said motor when said boat is propelled by a second motor.

14. The apparatus of claim 13 further comprising steering means for steering a boat, said steering means adapted to rotate said motor about a vertical axis when the apparatus is mounted onto a boat, said steering means being coupled to said movable portion.

15. The apparatus of claim 14 further comprising retaining means for retaining said movable portion in said second position.

16. An apparatus comprising:

(a) mounting means adapted for mounting an outboard motor onto a boat, said mounting means comprising:

(i) a fixed portion adapted to be fixedly coupled to said boat;

(ii) a movable portion moveably coupled to said fixed portion, said movable portion adapted to be coupled to said motor, said movable portion moving between as first position where said motor is submerged when said boat is in the water and a second position where said motor is unsubmerged when said boat is in the water;

(b) hydrofoil means for automatically raising said movable portion from said first position to said second position when said boat is being propelled through the water by alternative propulsion means, said hydrofoil means being coupled to said movable portion so as to be submerged when said movable portion is in the first position, wherein said hydrofoil means is adapted to couple to said motor, said motor being adapted to turn about a vertical axis, said hydrofoil means having most of its mass located rearwardly so as to automatically straighten said motor when said boat is propelled by said alternative propulsion means.

17. An apparatus comprising:

(a) mounting means adapted for mounting an outboard motor onto a boat, said mounting means comprising:

(i) a fixed portion adapted to be fixedly coupled to said boat;

(ii) a movable portion moveably coupled to said fixed portion, said movable portion adapted to be coupled to said motor, said movable portion moving between a first position where said motor is submerged when said boat is in the water and a second position where said motor is unsubmerged when said boat is in the water;

(b) hydrofoil means for automatically raising said movable portion from said first position to said second position when said boat is being propelled through the water by alternative propulsion means, said hydrofoil means being coupled to said movable portion so as to be submerged when said movable portion is in the first position, (c) steering means for steering a boat, said steering means adapted to rotate said motor about a vertical axis when the apparatus is mounted onto a boat, said steering means being coupled to said movable portion and comprising a steering motor.

18. An apparatus comprising:

(a) mounting means adapted for mounting an outboard motor onto a boat, said mounting means comprising:

(i) a fixed portion adapted to be fixedly coupled to said boat;

(ii) a movable portion moveably coupled to said fixed portion, said movable portion adapted to be coupled to said motor, said movable portion moving between a first position where said motor is submerged when said boat is in the water and a second position where said motor is unsubmerged when said boat is in the water;

(b) hydrofoil means for automatically raising said movable portion from said first position to said second position when said boat is being propelled through the water by alternative propulsion means, said hydrofoil means comprising a plate that is generally horizontal in orientation, said hydrofoil means being coupled to said movable portion so as to be submerged when said movable portion is in the first position;

(c) said hydrofoil means plate being located beneath said motor;

(d) said hydrofoil means is adapted to couple to said motor, said motor being adapted to turn about a vertical axis, said hydrofoil means having most of its mast located rearwardly so as to automatically straighten said motor when said boat is propelled by a second motor.

19. An apparatus, comprising:

(a) mounting means adapted for mounting an outboard motor to a boat, said mounting means comprising arm means having first and second ends, said first end of said arm means being adapted to be pivotally coupled to said boat such that said arm means second end can be pivoted relative to said boat;

(b) said second end of said arm means being adapted to couple to said motor, wherein said motor can be raised and lowered relative to a water line of said boat by pivoting said arm means relative to said boat;

(c) hydrofoil means coupled with said arm means second end such that said hydrofoil means is located below the water line of said boat when said motor is below the water line, said hydrofoil means comprising a plate that is generally horizontal in orientation, said hydrofoil means being for automatically raising said motor to a position above the water line from a position below the water line.

20. The apparatus of claim 19 wherein said hydrofoil means plate is located beneath said motor, said plate having trailing and leading edges, said plate being positioned at a slight angle relative to the water line of said boat such that said leading edge is above said trailing edge.

21. The apparatus of claim 20 wherein:

(a) said motor is rotatable with respect to said boat to provide directional control, said motor rotating about a vertical axis when said apparatus is installed onto said boat;

(b said hydrofoil means rotates with said motor, said hydrofoil means being positioned relative to said vertical axis such that most of said hydrofoil means is aft of said vertical axis so as to automatically straighten said motor when said boat is propelled by a second motor.

22. The apparatus of claim 19 wherein said hydrofoil means comprises a bottom portion and said portions extending laterally from said bottom portion, said bottom and side portions having a leading edge and a trailing edge, said side portions being turned upwardly from said bottom portion.

23. The apparatus of claim 22 wherein:

(a) said motor is rotatable with respect to said boat to provide directional control, said motor rotating about a vertical axis when said apparatus is installed onto said boat;

(b) said hydrofoil means rotates with said motor, said hydrofoil means being positioned relative to said vertical axis such that most of said hydrofoil means is aft of said vertical axis so as to automatically straighten said motor when said boat is propelled by a second motor.

24. The apparatus of claim 19 wherein said arm means is adapted to extend in a general fore and aft direction relative to said boat.

25. The apparatus of claim 24 wherein said hydrofoil means comprises a plate located beneath said motor when said motor is coupled to said movable portion.

26. The apparatus of claim 24 wherein said hydrofoil means is located beneath said motor when said motor is coupled to said movable portion, said hydrofoil means having a central portion and sides that extend laterally outward from said central portion, said hydrofoil means being contoured such that said sides extend upwardly from the central portion of said hydrofoil means when the apparatus is mounted onto a boat.

27. The apparatus of claim 26 further comprising steering means for steering a boat, said steering means adapted to rotate said motor about a vertical axis when the apparatus is mounted onto a boat, said steering means being coupled to said movable portion.

28. The apparatus of claim 27 further comprising retaining means for retaining said arm means in an up position.

29. An apparatus, comprising:

(a) mounting means adapted for mounting an outboard motor to a boat, said mounting means comprising arm means having first and second ends, said first end of said arm means being adapted to be pivotally coupled to said boat such that said arm means second end can be pivoted relative to said boat;

(b) said second end of said arm means being adapted to couple to said motor, wherein said motor can be raised and lowered relative to a water line of said boat by pivoting said arm means relative to said boat;

(c) hydrofoil means coupled with said arm means second end such that said hydrofoil means is located below the water line of said boat when said motor is below the water line, said hydrofoil means being for automatically raising said motor to a position above the water line from a position below the water line, wherein said arm means is adapted to extend laterally of a center line of said boat such that said arm means pivots about an axis that is generally parallel to said center line of said boat.

30. The apparatus of claim 29 wherein said hydrofoil means comprises a plate located beneath said motor when said motor is coupled to said movable portion.

31. The apparatus of claim 29 wherein said hydrofoil means is located beneath said motor when said motor is coupled to said movable portion, said hydrofoil means having a central portion and sides that extend laterally outward from said central portion, said hydrofoil means being contoured such that said sides extend upwardly from the central portion of said hydrofoil means when the apparatus is mounted onto a boat.

32. The apparatus of claim 31 further comprising steering means for steering a boat, said steering means adapted to rotate said motor about a vertical axis when the apparatus is mounted onto a boat, said steering means being coupled to said movable portion.

33. The apparatus of claim 32 further comprising retaining means for retaining said arm means in an up position.

34. The apparatus of claim 29 further comprising means for limited downward movement of said arm means.

35. The apparatus of claim 30 wherein said plate has trailing and leading edges, said plate being positioned at a slight angle relative to the water line of said boat such that said leading edge is higher than said trailing edge.

36. The apparatus of claim 35 wherein said hydrofoil means is coupled to said motor which can rotate for steering control, said hydrofoil means being located aftwardly so as to automatically straighten said motor when said boat is propelled by a second motor.

37. An apparatus, comprising:

(a) mounting means adapted for mounting an outboard motor to a boat, said mounting means comprising arm means having first and second ends, said first end of said arm means being adapted to be pivotally coupled to said boat such that said arm means second end can be pivoted relative to said boat;

(b) said second end of said arm means being adapted to couple to said motor, wherein said motor can be raised and lowered relative to a water line of said boat by pivoting said arm means relative to said boat;

(c) hydrofoil means coupled with said arm means second end such that said hydrofoil means is located below the water line of said boat when said motor is below the water line, said hydrofoil means being for automatically raising said motor to a position above the water line from a position below the water line;

(d) wherein said arm means comprises plural mounting arms, each mounting arm having first and second ends, with said first end of each mounting arm being adapted to pivotally couple to said boat such that said mounting arms extend laterally of a center line of said boat, said second end of each arm being adapted to be pivotally coupled with said motor, said mounting arms being parallel to each other.

38. The apparatus of claim 37 wherein said hydrofoil means comprises a plate located beneath said motor when said motor is coupled to said movable portion.

39. The apparatus of claim 37 wherein said hydrofoil means is located beneath said motor when said motor is coupled to said movable portion, said hydrofoil means having a central portion and sides that extend laterally outward from said central portion, said hydrofoil means being contoured such that said sides extend upwardly from the central portion of said hydrofoil means when the apparatus is mounted onto a boat.

40. The apparatus of claim 39 further comprising steering means for steering a boat, said steering means adapted to rotate said motor about a vertical axis when the apparatus is mounted onto a boat, said steering means being coupled to said movable portion.

41. The apparatus of claim 40 further comprising retaining means for retaining said arm means in an up position.

42. The apparatus of claim 37 further comprising means for limited downward movement of said arm means.

43. The apparatus of claim 38 wherein said plate has trailing and leading edges, said plate being positioned at a slight angle relative to the water line of said boat such that said leading edge is higher than said trailing edge.

44. The apparatus of claim 43 wherein said hydrofoil means is coupled to said motor which can rotate for steering control, said hydrofoil means being located aftwardly so as to automatically straighten said motor when said boat is propelled by a second motor.

45. The apparatus of claim 25 wherein said plate has trailing and leading edges, said plate being positioned at a slight angle relative to the water line of said boat such that said leading edge is higher than said trailing edge.

46. The apparatus of claim 45 wherein said hydrofoil means is coupled to said motor which can rotate for steering control, said hydrofoil means being located aftwardly so as to automatically straighten said motor when said boat is propelled by a second motor.

47. An apparatus for automatically raising first propulsion means on a boat, said boat having second propulsion means in addition to said first propulsion means, comprising:

(a) mounting means for mounting said first propulsion means to said boat such that said first propulsion means can move up and down between a submerged position and an unsubmerged position when said boat is in the water;

(b) hydrofoil means for automatically raising said movable portion from said first position to said second position when said boat is being propelled by said propulsion means, said hydrofoil means comprising a plate that is generally horizontal in orientation, said hydrofoil means being coupled to said movable portion so as to be submerged when said movable portion is in the first position and said boat is in the water.

48. The apparatus of claim 47 wherein said first propulsion means comprises a trolling motor.

49. An apparatus for automatically raising an outboard motor on a boat, said boat having propulsion means in addition to said outboard motor, comprising:

(a) mounting means for mounting said motor to said boat, said mounting means comprising:

(i) a fixed portion which is fixed to said boat;

(ii) a movable portion moveably coupled to said fixed portion, said motor coupled to said movable portion, said movable portion moving between a first position where said motor is submerged when said boat is in the water and a second position where said motor is unsubmerged when said boat is in the water;

(b) hydrofoil means for automatically raising said movable portion from said first position to said second position when said boat is being propelled by said propulsion means, said hydrofoil means being coupled to said movable portion so as to be submerged when said movable portion is in the first position and said boat is in the water;

(c) locking means for automatically locking said movable portion and said motor in the second position.

50. An apparatus for automatically raising an outboard motor on a boat, said boat having propulsion means in addition to said outboard motor, comprising:

(a) mounting means for mounting said motor to said boat, said mounting means comprising:

(i) a fixed portion which is fixed to said boat;

(ii) a movable portion moveably coupled to said fixed portion, said motor coupled to said movable portion, said movable portion moving between a first position where said motor is submerged when said boat is in the water and a second position where said motor is unsubmerged when said boat is in the water;

(b) hydrofoil means for automatically raising said movable portion from said first position to said second position when said boat is being propelled by said propulsion means, said hydrofoil means being coupled to said movable portion so as to be submerged when said movable portion is in the first position and said boat is in the water, wherein said hydrofoil means comprises a plate having trailing and leading edges, said plate being positioned at a slight angle relative to a water line of said boat when said movable portion is in the first position such that said leading edge is closer to the water line than is said trailing edge;

(c) said hydrofoil means plate comprising lateral edges, wherein said plate has curved portions near said lateral edges.

51. An apparatus, comprising:

(a) mounting means adapted for mounting an outboard motor to a boat, said mounting means comprising arm means having first and second ends, said first end of said arm means being adapted to be pivotally coupled to said boat such that said arm means second end can be pivoted relative to said boat;

(b) said second end of said arm means being adapted to coupled to said motor, wherein said motor can be raised and lowered relative to a water line of said boat by pivoting said arm means relative to said boat;

(c) hydrofoil means coupled with said arm means second end such that said hydrofoil means is located below the water line of said boat when said motor is below the water line, said hydrofoil means being for automatically raising said motor to a position above the water line from a position below the water line;

(d) said arms means comprising plural mounting arms, each mounting arm having first and second ends, with said first end of each mounting arm being adapted to pivotally couple to said boat such that said mounting arms extend in a general fore and aft direction relative to said boat, said second end being adapted to be pivotally coupled to said motor.

52. The apparatus of claim 51 wherein said hydrofoil means maintains a relatively constant orientation with respect to a waterline of said boat when said motor is raised and lowered.

* * * * *